US009637250B2

(12) United States Patent
Biason

(10) Patent No.: US 9,637,250 B2
(45) Date of Patent: May 2, 2017

(54) MACHINE FOR PACKING SAND, GRAVEL, CLAY, EARTH AND HUMID GRANULATED MATERIAL SUCH AS MORTAR AND ORGANIC FERTILIZER IN BAGS

(71) Applicant: Valter Vladimir Biason, Santa Catarina (BR)

(72) Inventor: Valter Vladimir Biason, Santa Catarina (BR)

( * ) Notice: Subject to any disclaimer, the term of this patent is extended or adjusted under 35 U.S.C. 154(b) by 0 days.

(21) Appl. No.: 14/759,705

(22) PCT Filed: Dec. 6, 2013

(86) PCT No.: PCT/BR2013/000546

§ 371 (c)(1),
(2) Date: Jul. 8, 2015

(87) PCT Pub. No.: WO2014/107778

PCT Pub. Date: Jul. 17, 2014

(65) Prior Publication Data

US 2015/0336687 A1 Nov. 26, 2015

(30) Foreign Application Priority Data

Jan. 8, 2013 (BR) ..... 1020130004600

(51) Int. Cl.

*B65B 1/08* (2006.01)
*B65B 39/00* (2006.01)
*B65B 1/32* (2006.01)

(52) U.S. Cl.

CPC ..... *B65B 1/08* (2013.01); *B65B 1/32* (2013.01); *B65B 39/007* (2013.01)

(58) Field of Classification Search

CPC ..... G01G 13/00; B65B 39/002; B65B 1/08; B65B 1/32; B65B 39/007

USPC ..... 141/114, 71–81, 83, 313–317; 222/179, 222/247; 366/113, 114

See application file for complete search history.

(56) References Cited

U.S. PATENT DOCUMENTS 1,783,423 A * 12/1930 Harper ..... B01J 8/003 111/76
2,110,687 A * 3/1938 Weinstein ..... B65B 39/002 222/179
3,126,288 A * 3/1964 Strasburger ..... B65B 37/04 141/78
4,688,610 A * 8/1987 Campbell ..... B65B 1/34 141/120
6,047,863 A * 4/2000 Kanzler ..... B65B 1/08 141/313
6,112,956 A * 9/2000 Malone ..... B65B 1/42 141/231

FOREIGN PATENT DOCUMENTS

BR 8101333 U * 6/2003

OTHER PUBLICATIONS

Google translation of BR8101333U.

* cited by examiner

*Primary Examiner* — Mark A Laurenzi
*Assistant Examiner* — Timothy P Kelly

(57) ABSTRACT

The invention relates to a machine for bagging sand, grit, mud, earth and wet granulates such as mortar and organic compost, using a single structure comprising a storage silo, a vibrator assembly, a metering device, a weighing device and a support structure. Space and time are optimized, ergonomics and ease of use are improved, and the final product is standardized.

5 Claims, 7 Drawing Sheets

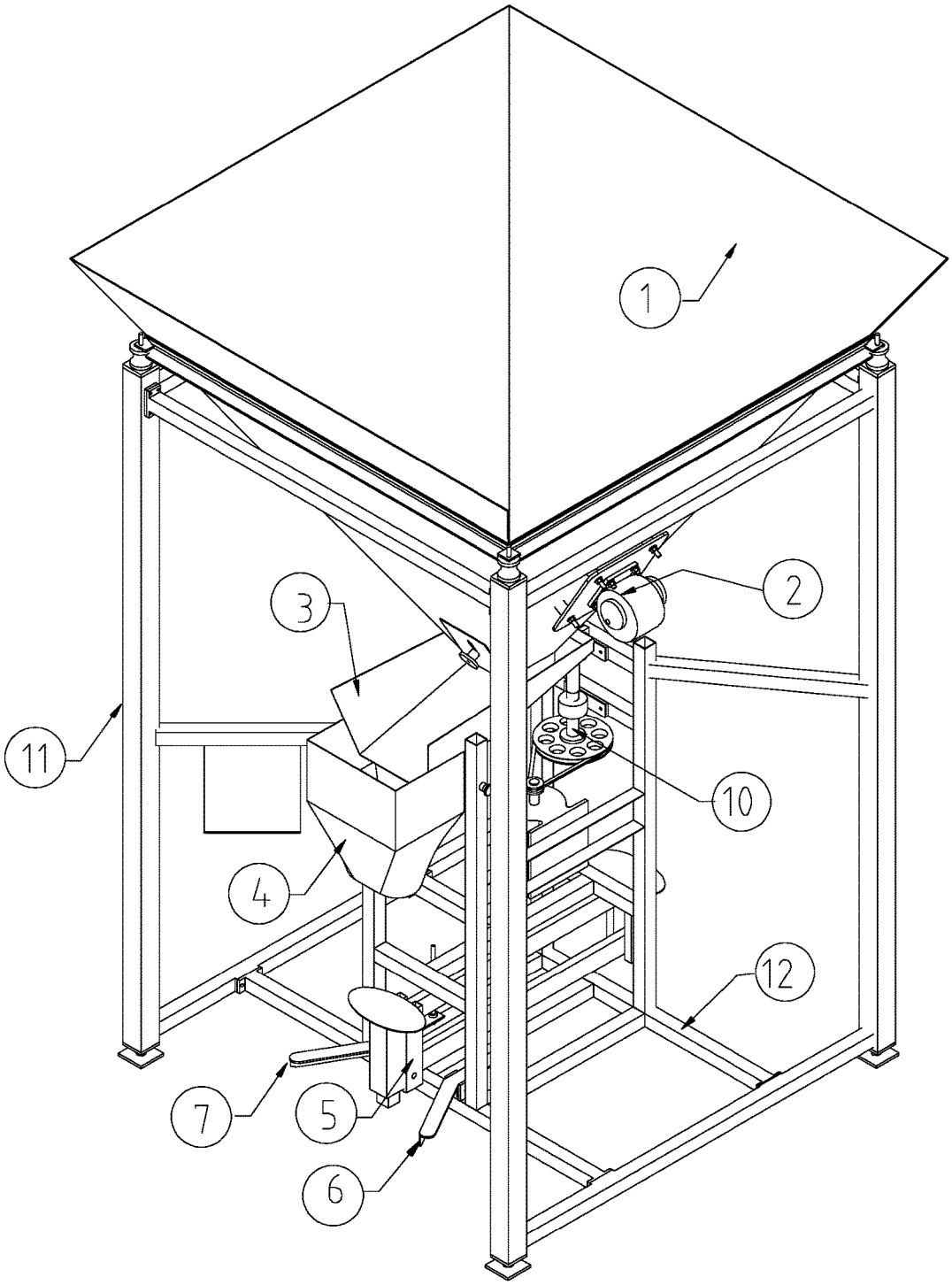
FIG. 1.1

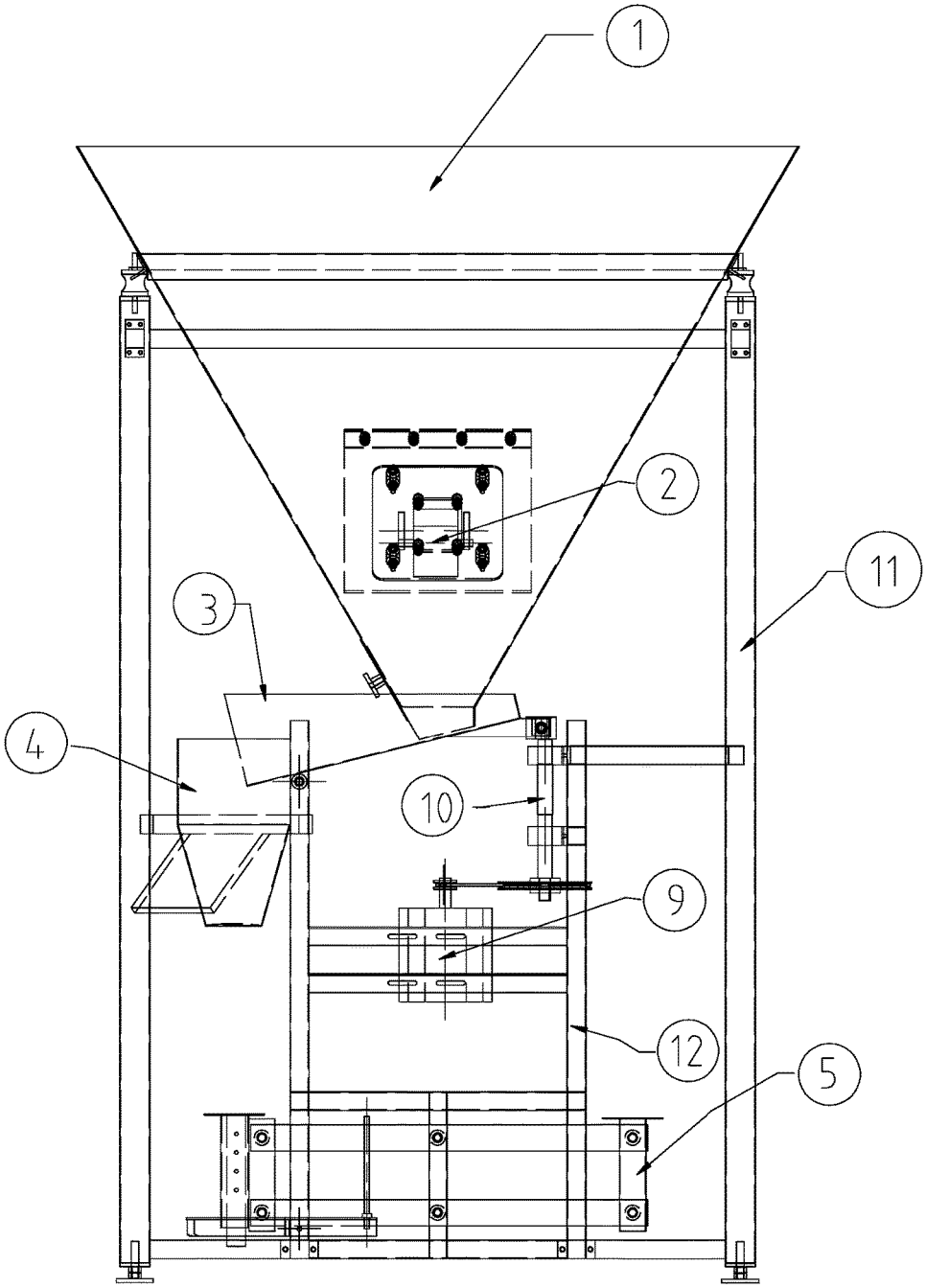
FIG. 1.2

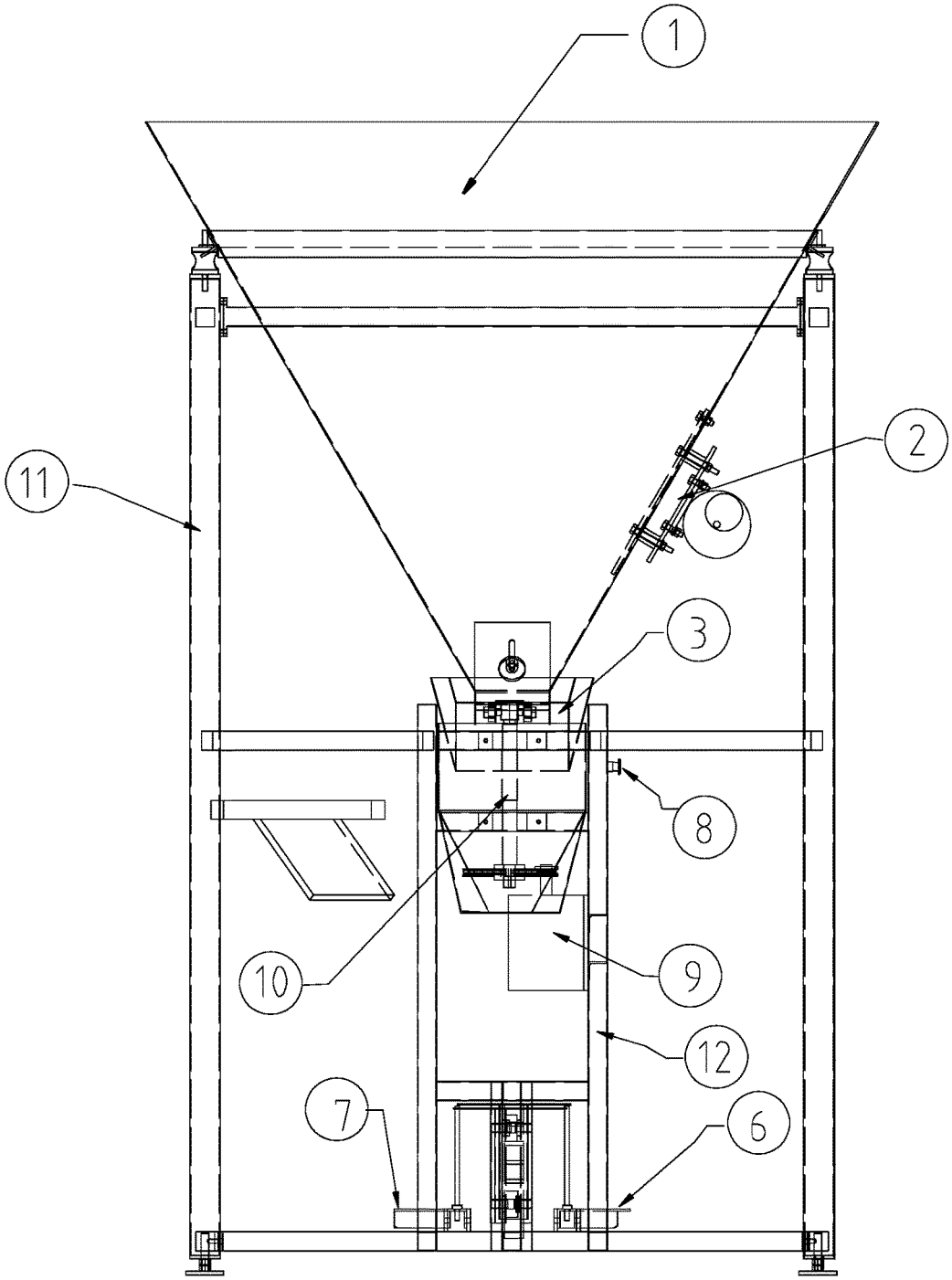
FIG. 1.3

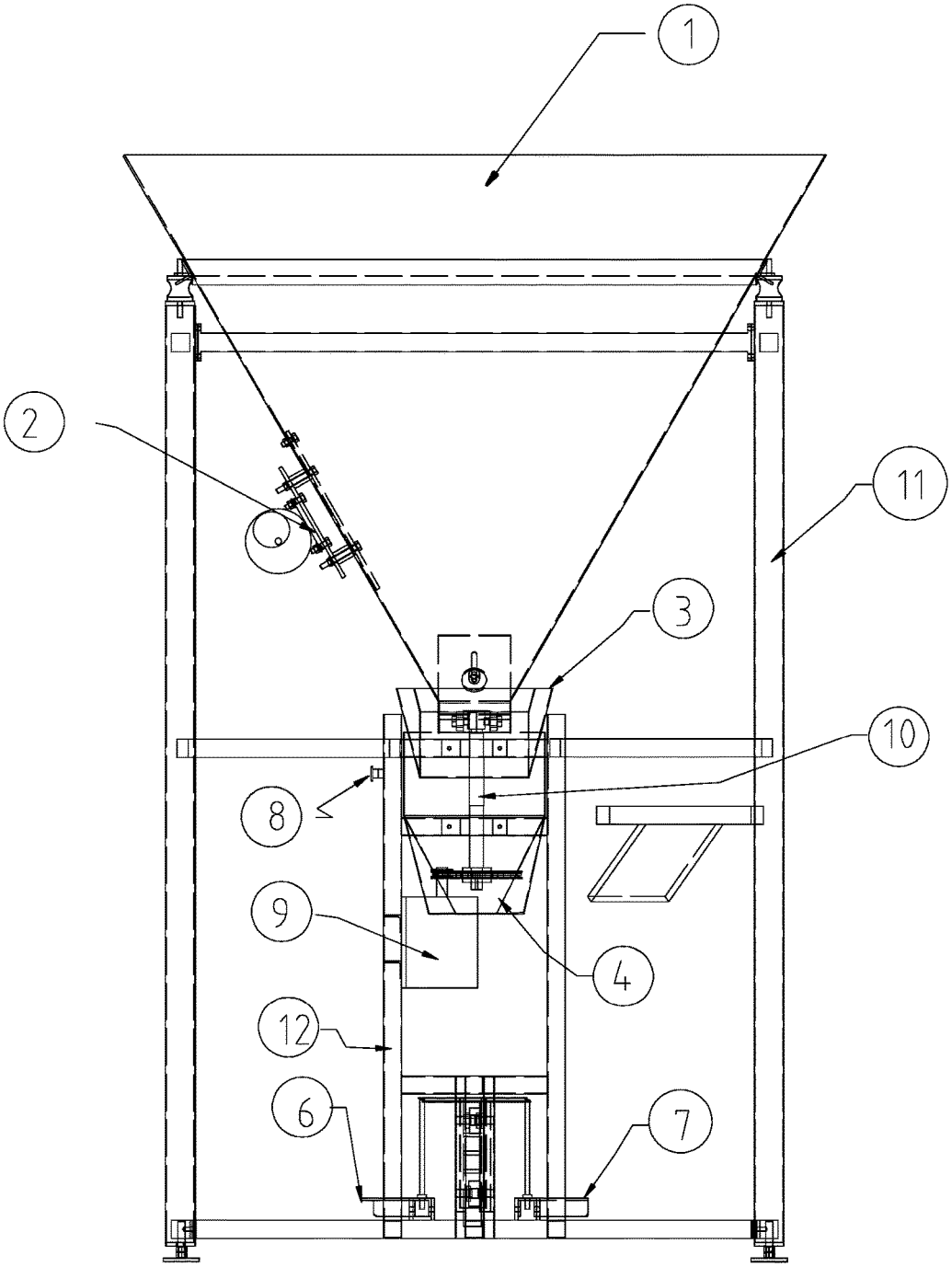
FIG. 1.4

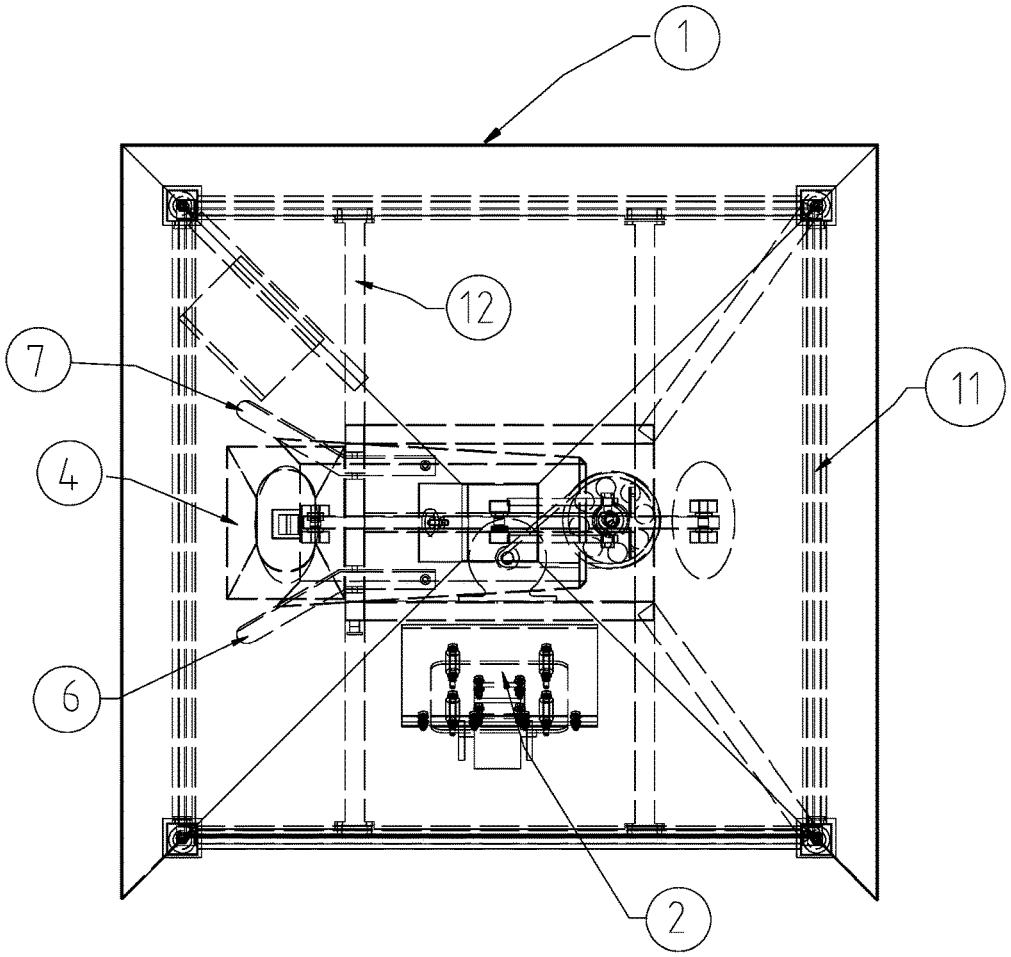
FIG. 1.5

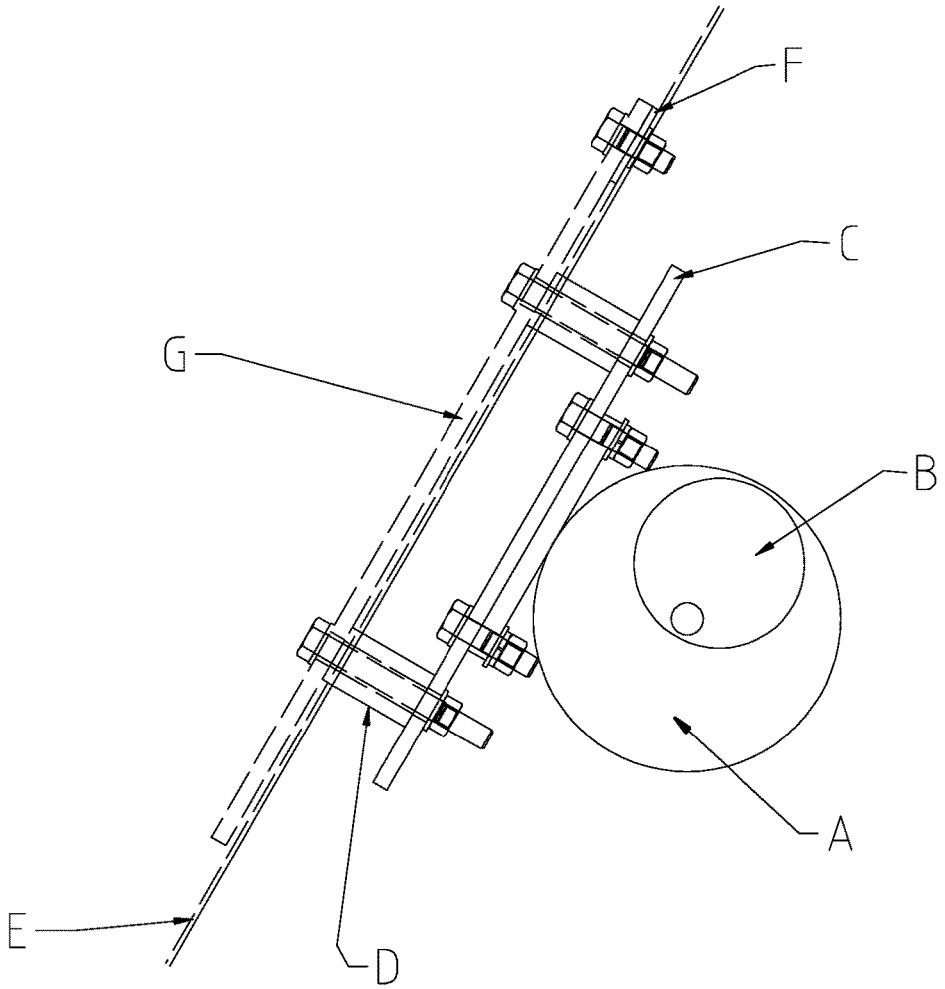
FIG. 1.6

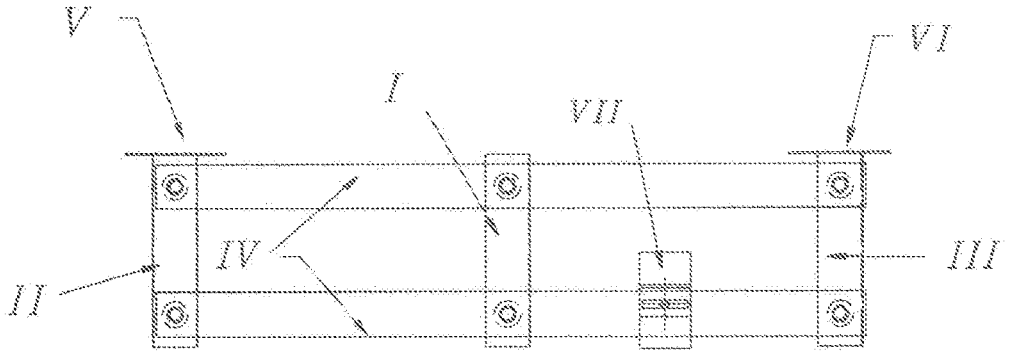
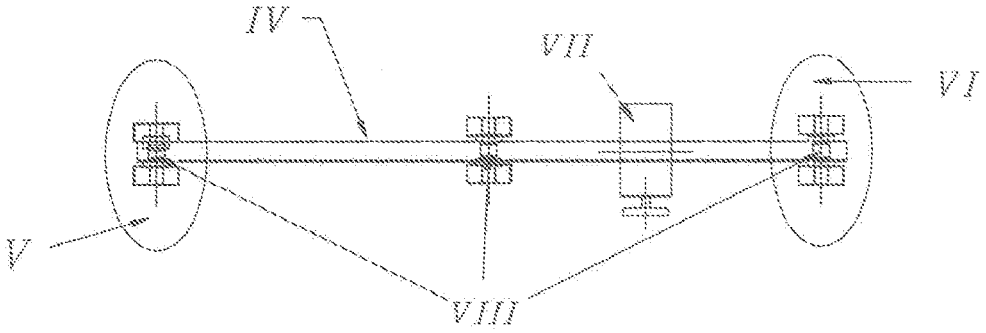
FIG. 1.7

MACHINE FOR PACKING SAND, GRAVEL, CLAY, EARTH AND HUMID GRANULATED MATERIAL SUCH AS MORTAR AND ORGANIC FERTILIZER IN BAGS

The present invention refers to a machine for packing sand, gravel, clay, earth and humid granulated material, such as mortar and organic fertilizer, in bags.

Building material stores selling sand, gravel, clay and mortar, as well as the producers of organic fertilizers, sell those materials in bags and, on occasion, by weight (20 kg), others by volume (20 liters).

Currently, the most common process consists in using a bottomless bucket located inside an empty pack. The bucket is filled in with a shovel on its upper portion and, after the bucket is taken off, the product is left inside the package, which may be of raffia or plastic. The closing process depends on each retailer; some use stitched raffia or simply a knot; and, in cases of plastic packages, these may be sealed, tied up with strands or even delivered open.

It may be considered a costly, stressful, ergonomically incorrect and time-taking procedure.

It is known that fine and humid sand or humid mortar are made of two kinds of fine sand, fumed lime and water. They are highly viscous and sticky and, if they are included in a container with slope lower than 54°, they will not go down with gravity force, sticking to the walls of the container and forming "caves", obstructing their flow.

There are many manufacturers of packing machines for various kinds of products, but, considering abrasion, weight, viscosity, adherence and low commercial value of sand and mortar, few companies have developed this kind of machine. Those in existence have very high costs, occupy large spaces and are not directly fed, thus requiring belt conveyors.

Packing machines with valve systems do not work with humid products, since they quickly wear the endless worm due to abrasion.

The method disclosed in this document is the use of a machine to pack into bags said humid granulates such as sand, mortar and also gravel, clay and earth by using a carrying shovel with wheels (backhoe) with a large volume for direct deposition to the upper part of the machine, using a vibrator set to avoid fine sand and mortar to stick to the walls, descending to an oscillating tray from which they are sent to a funnel to wait for the empty pack to be filled in. To provide for correct regulation, the equipment has a scale with the calculated volume or weight in an adjustable edge, checking the same value at the other edge.

The activating system for the oscillating tray is by means of a pedal with automatic turn-off with a button incorporated to the scale. The activating system for the vibrating set is also made by pedal, but separately from the former.

The whole process is constituted in a single structural base with four adjustable feet, enabling to move around the whole set and occupying a space of less than 3 $m^3$.

Other features of the invention are as follows:

- it gives the operator an ergonomically correct position with low effort and comfortable use;
- low noise emission, since the vibrating set will only be turned on if necessary;
- lower commercial value against the other machines in the market;
- high yielding;
- use of only one machine for various kinds of materials; and
- one single operator performs the whole process.

The disclosure below and the related figures, as a non-limitative example, will bring in better understanding of the innovation.

FIG. 1.1 shows a perspective view.

FIG. 1.2 shows a side view.

FIG. 1.3 shows a front view.

FIG. 1.4 shows a rear view.

FIG. 1.5 shows an upper view.

FIG. 1.6 shows the parts of the vibrating set.

FIG. 1.7 shows the parts of the scale.

To better understand the figures, we have given numbers to the parts:

1 Silo.

2 Vibrating set: (A) engine; (B) vibrating weight; (C) engine plate; (D) extender; (E) silo plate; (F) fixing rubber; and (G) vibrating plate.

3 Oscillating tray.

4 Funnel.

5 Scale (I) core plate (II) front plate (III) back plate (IV) crosswise plates (V) front cradle (VI) back cradle (VII) moving adjustable weight (VIII).

6 Pedal for the oscillating tray.

7 Pedal for the vibrating set.

8 Turn-off button for the doser.

9 Engine for the oscillating tray.

10 Oscillating axis.

11 Sustaining structure.

12 Doser composed by the items oscillating tray (3), funnel (4), scale (5), pedal for the oscillating tray (6), pedal for the vibrating set (7), turn-off button (8), engine for oscillating tray (9), oscillating axis (10), emergency (13).

13 Emergency button.

FIG. 1.7 shows the scale composed by a central plate (I) fixed to the machine, leaving the moving cross plates (IV) by means of the pins with a nylon bush (VIII). The volume or weight to be packed into bags is put on the back cradle (VI) fixed to the back plate (III), providing the same amount to be on the front cradle (V) fixed to the front plate (II). For better regulation, a moving regulation weight (VII) is added.

As shown by FIG. 1.1 from the perspective view, the product to be packed in bags is loaded to the silo (1) by the side part of the machine with a carrying shovel with wheels (backhoe). Pushing the activating pedal for the oscillating tray (6) turns on the engine for the oscillating tray (9), starting the filling operation.

FIGS. 1.1 in perspective, 1.2 side view, 1.3 front view, 1.4 rear view and 1.5 upper view show the vibrating set (2) as detailed by FIG. 1.6 which, when activated by the pedal for the vibrating set (7) guides the material to the oscillating tray (3) sending it to a funnel (4) under which the pack to be filled in is located. When that package has the same volume or weight on the back cradle (VI) of the scale (5), it descends the front cradle (V) and activates the turn-off button for the doser (7).

The silo (1) is manufactured with carbon steel plates about 3 mm thick with slope of more than 54° and, on one side on its lower part, at least 2250 mm wide to enable a spoon of the carrying shovel with wheels to deposit the material. On the lower part, there is a mouth not smaller than 200×200 for the flow of the product to be packed at a maximum height of 2500 mm when already assembled over the machine.

FIG. 1.6 shows the vibrating set (2) to pack the material in bags, avoiding the material to stick to the walls forming caves from the silo (1) to the oscillating tray (3), constituted by an engine (A) which, in its axis, has an eccentric weight (B) to perform the vibration, which is transferred to the 4 mm carbon steel plate (C) of the engine, transferring it to the prolongers (D) shaking the 4 mm vibrating carbon steel plate (G) which is screwed to the silo (1) plate; to provide for better durability and less noise between them, in a fixing rubber (F) with at least three canvas is included between them and activated by the pedal of the vibrating set (7).

The vibrating set (2) is screwed to the lower part of the silo (1) and, over the upper part of the supporting structure (11), a square 80×80×3 mm tube is supported, wherein, at the lower portion, the doser (12) is fixed and constituted by the items oscillating tray (3), funnel (4), scale (5), pedal for the oscillating tray (6), pedal for the vibrating set (7), turn-off button (8), engine for the oscillating tray (9), oscillating axis (10) and emergency (13), as detailed on FIGS. 1.2 side view, 1.3 front view and 1.4 rear view.

The sloped 3 mm oscillating tray (3) of carbon steel is attached to the oscillating axis (10) exiting from the engine for the oscillating tray (9) which, when activated by the oscillating tray pedal (6), starts a back-and-forth movement, guiding the material to be packed into bags to the funnel (4) where the package is located, and is deactivated by the turn-off button (8) installed on the scale (5).

For better safety, a red Emergency button (13) is provided to turn off the whole system.

The invention claimed is:

1. MACHINE FOR PACKING SAND, GRAVEL, CLAY, EARTH AND HUMID GRANULATED MATERIAL SUCH AS MORTAR AND ORGANIC FERTILIZER IN BAGS, comprising:

a silo (1) assembled over a support structure (11);

a vibrating set (2) located over one of the walls of the silo (1);

a funnel having an outlet;

a tray (3) assembled shortly below the silo (1), with an upper edge of the tray (3) located next to the outlet of the funnel, wherein the tray is oscillatory and operating over an oscillating set which includes an engine (9) fixed to the structure (11) of the machine, the tray (3) is connected to a vertical oscillating axis (10) that is further connected to the oscillating set and the tray (3) performs the back-and-forth movement when in use; and a scale (5) on the lower part of said machine, comprised by two crosswise plates (IV), horizontal alongside the structure (11) of the machine and located in parallel, vertically one over the other, duly spaced and joined by means of a front plate (II), a back plate (III) and a middle plate (I), all of them pivoted to crosswise plates (IV), and the crosswise plates (IV) being pivoted, at its middle region, to the structure of said machine, so to allow the performance of a seesaw movement and said scale (5) including a front cradle (V) located over the front plate (II) on the frontal part of the machine, vertically aligned to the outlet of the funnel (4), and including a back cradle (VI) located over the back plate (III) on a back part of the machine.

2. The MACHINE FOR PACKING SAND, GRAVEL, CLAY, EARTH AND HUMID GRANULATED MATERIAL SUCH AS MORTAR AND ORGANIC FERTILIZER IN BAGS according to claim 1, wherein the vibrating set (2) includes an engine (A) containing an eccentric weight (B) and fixed to a sustaining plate (C) which, by means of a prolonger (D), is fixed to a second internal plate (G) fixed over the internal surface of the wall (E) of the silo (1).

3. The MACHINE FOR PACKING SAND, GRAVEL, CLAY, EARTH AND HUMID GRANULATED MATERIAL SUCH AS MORTAR AND ORGANIC FERTILIZER IN BAGS according to claim 2, wherein the internal plate (G) is fixed on one side, fixed only on its upper part and containing a spacing rubber (F) located between the internal plate (G) and the wall (E) of the silo (1).

4. The MACHINE FOR PACKING SAND, GRAVEL, CLAY, EARTH AND HUMID GRANULATED MATERIAL SUCH AS MORTAR AND ORGANIC FERTILIZER IN BAGS according to claim 1, further comprising, at the lower part of the machine, a pedal (6) to turn on the engine (9) of the oscillating set; and a pedal (7) to turn on the vibrator set (2) of the silo (1).

5. The MACHINE FOR PACKING SAND, GRAVEL, CLAY, EARTH AND HUMID GRANULATED MATERIAL SUCH AS MORTAR AND ORGANIC FERTILIZER IN BAGS according to claim 1, further comprising: a button (8) to turn off the engine (9) of the oscillating set, located sidewise to one of the crosswise plates (IV) of the scale (5), and the displacement of said one of the crosswise plates (IV) touches said button (8), displacing it from its "on" position to its "off" position.

* * * * *